US005713760A

United States Patent [19]

Chemin

[11] Patent Number: 5,713,760

[45] Date of Patent: Feb. 3, 1998

[54] CONNECTOR HAVING A TERMINAL-LOCKING GRIP

[75] Inventor: Gilles Chemin, Toulouse, France

[73] Assignee: Framatome Connectors International, Courbevoie, France

[21] Appl. No.: 574,022

[22] Filed: Dec. 18, 1995

[30] Foreign Application Priority Data

Dec. 19, 1994 [FR] France ..... 94 15244

[51] Int. Cl.[6] ..... H01R 13/40

[52] U.S. Cl. ..... 439/595

[58] Field of Search ..... 439/595, 744, 439/603, 752

[56] References Cited

U.S. PATENT DOCUMENTS

| | | | |
|---|---|---|---|
| 5,002,504 | 3/1991 | Carson | 439/595 X |
| 5,059,142 | 10/1991 | Ohta et al. | 439/752 |
| 5,108,318 | 4/1992 | Sakurai et al. | 439/744 OR |
| 5,139,447 | 8/1992 | Yoneda et al. | 439/752 |
| 5,167,534 | 12/1992 | Ohsumi | 439/595 |
| 5,292,261 | 3/1994 | Hirano et al. | 439/752 |
| 5,474,477 | 12/1995 | Aoyama | 439/752 OR |
| 5,516,308 | 5/1996 | Yamanashi | 439/752 OR |

FOREIGN PATENT DOCUMENTS 2702889 9/1994 France .

*Primary Examiner*—P. Austin Bradley
*Assistant Examiner*—Daniel Wittels
*Attorney, Agent, or Firm*—Pollock, Vande Sande & Priddy

[57] ABSTRACT

An electrical connector has a body of rectangular cross-section of insulating material and is formed with two rows of passages parallel to a plugging direction and receiving respective contact terminals. Each passage has side walls which are parallel to the rows and are cut out to form detents whose resilience tends to bring them into a position where they project into the respective passage and where they retain the respective contact terminals. A front retaining plate bears against a front end face of the body and is provided with resilient retaining fingers arranged for engaging the body. A locking grid has two side flanks that are spaced apart so as to straddle two faces of the body and to prevent the detents from flexing away from the positions in which they project into the passages. The grid has tabs for latching on two other faces of the body for holding an end wall of the grid against the front retaining plate.

8 Claims, 2 Drawing Sheets

FIG.3.
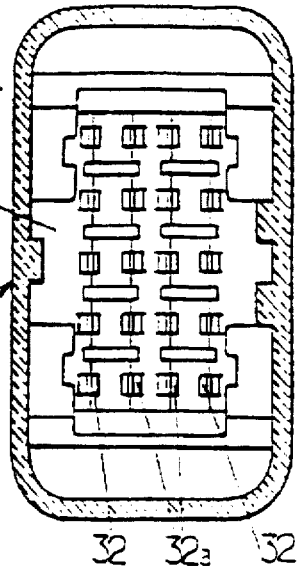
FIG.4.
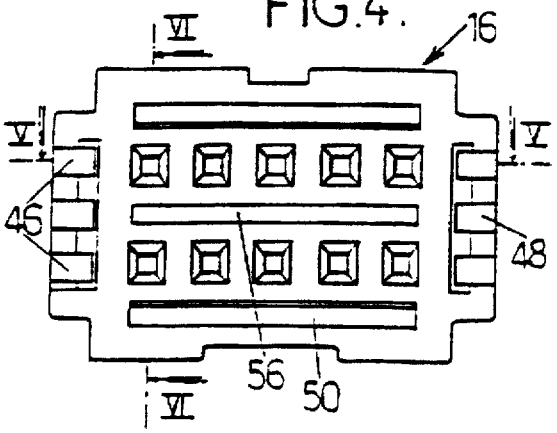
FIG.7.
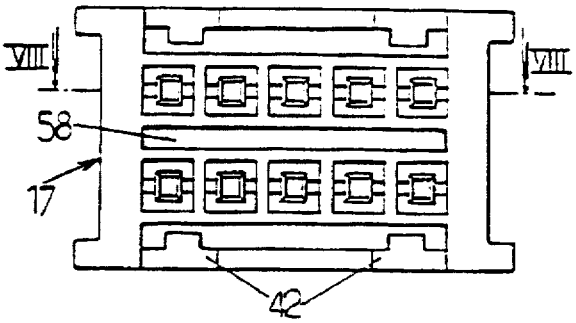
FIG.5.
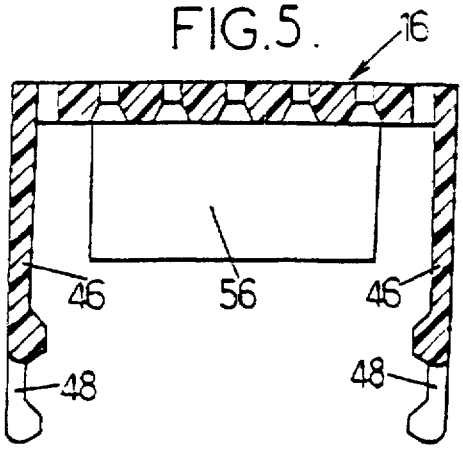
FIG.8.
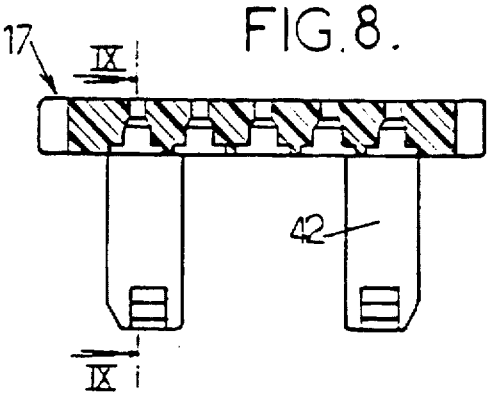
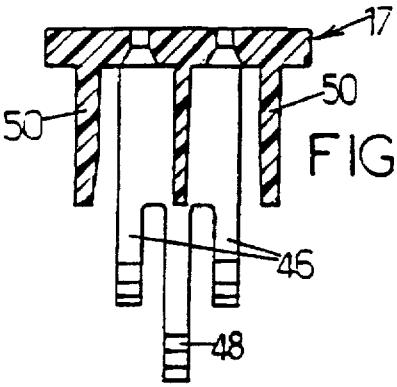
FIG.6.
FIG.9.
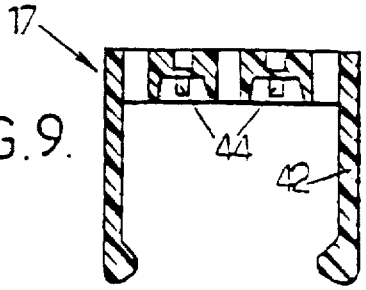

CONNECTOR HAVING A TERMINAL-LOCKING GRIP

BACKGROUND OF THE INVENTION

The present invention relates to an electrical connector to be coupled to a complementary connector by plugging. More particularly, it relates to an electrical connector of the type having a body of rectangular cross-section made of insulating material and formed with at least two rows of passages parallel to the plugging direction and designed to receive respective contact terminals, the two side walls of each passage parallel to the rows being cut out to form detents whose resilience tends to bring them towards a position in which they project into the passage and retain the terminals.

In miniature connectors increasingly being used in electronics, in particular in cars, the detents are very thin and fragile, and hence are at risk of bending or breaking and thus allowing untimely release of the contacts.

Proposals have already been made for connectors that comprise an additional part, often referred to as a "grid", which covers the front end portion of the connector body and prevents the detents from bending and thus releasing the contacts while the grid is in place. The grid is generally designed so that it can be inserted only when the terminals are fully pushed home and locked in place. Otherwise the grid comes into abutment against detents that are flexed outwards.

SUMMARY OF THE INVENTION

It is an object of the invention is to provide a connector having a grid for performing "secondary" locking by locking the detents. Locking is thus much more secure than the primary locking due to the resilience of the detents. In the proposed connector, assembly is simplified by the terminals being held temporarily until the grid is put fully into place, and the components can be made by molding.

To this end, the invention proposes a connector of the above-specified type, further having.

- a front retaining plate bearing against the front end face of the body, formed with holes each allowing a projecting end portion of a terminal to pass through and constituting an abutment for a shoulder on the terminal, the retaining plate being provided with resilient retaining fingers for engaging the body; and
- a locking grid made as a single part and having two side flanks that are spaced apart so as to straddle those two faces of the body that are parallel to the rows and prevent the detents from flexing away from their positions in which they project into the passages, and tabs for latching on the two faces of the body that are orthogonal to the rows, for the purpose of holding the end wall of the grad against the retaining plate, the end wall being formed with holes for passing the terminal end portions.

Because the detents are relatively fragile, it is advantageous for the body to include a separating partition between adjacent rows of passages, with pairs of detents being cut out therein so that each terminal is retained by two detents. The partition or each partition then preferably has a middle groove between pairs of detents, and the grid has a projection for engaging in each such groove and preventing the detents in a pair from moving towards each other.

To facilitate assembly of the terminals, the locking grid may also include temporary support tabs that are longer than the latching tabs and that are designed to hold the grid in a forward position in which it allows the detents to flex, while also providing axial guidance for the terminals, with the terminals being held firstly by the holes through the grid and secondly by the holes in the plate.

The connector is practically usable with terminals having front end portions in the form of tongues that project beyond the grid in order to engage in cage-type terminals of a complementary connector.

BRIEF DESCRIPTION OF THE DRAWINGS

The above features and others will be more clearly understood upon reading the following description of a particular embodiment of the invention, given by way of example. The description refers to the accompanying drawings in which

FIG. 3 is a section along line III—III of FIG. 2;

FIG. 4 shows the locking grid of the connector as seen from the bottom of FIG. 5, i.e., from behind;

FIGS. 5 and 6 are respective sectional views on lines V—V and VI—VI of FIG. 4;

FIG. 7 is a view from behind of the abutment plate of the FIG. 1 connector; and FIGS. 8 and 9 are respective section views along lines VIII—VIII of FIG. 7 and IX—IX of FIG. 8.

DESCRIPTION OF PREFERRED EMBODIMENT

Figure 2A:
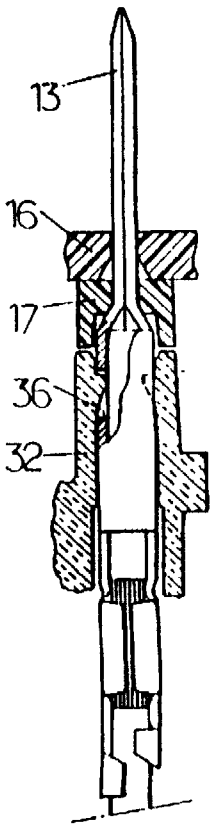
FIG. 2A is a view on a larger scale of a fragment of FIG. 2, showing a contact terminal in place.
Figure 2:
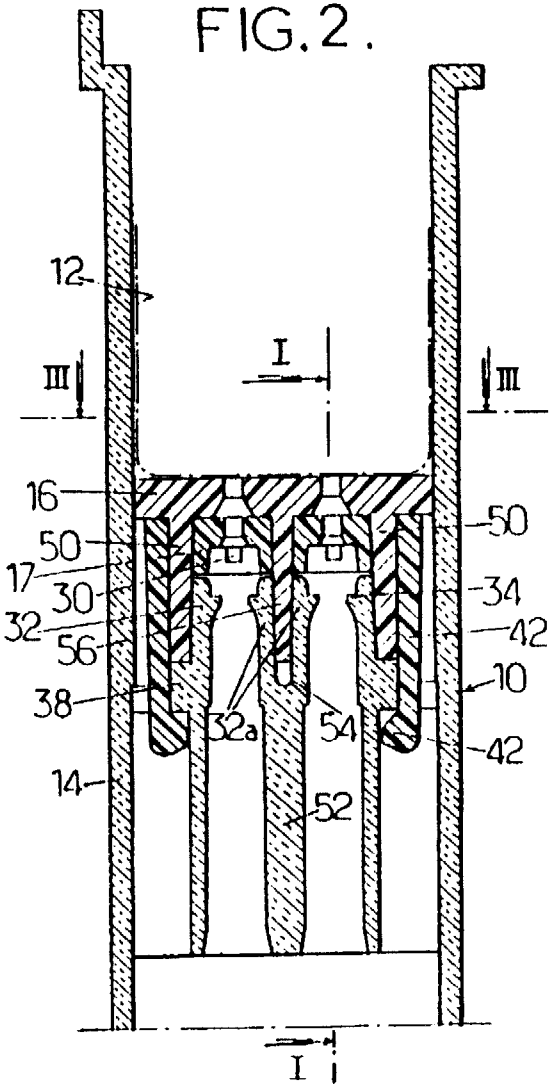
FIG. 2 is a cross-section along line II—II of FIG. 1.
Figure 1:
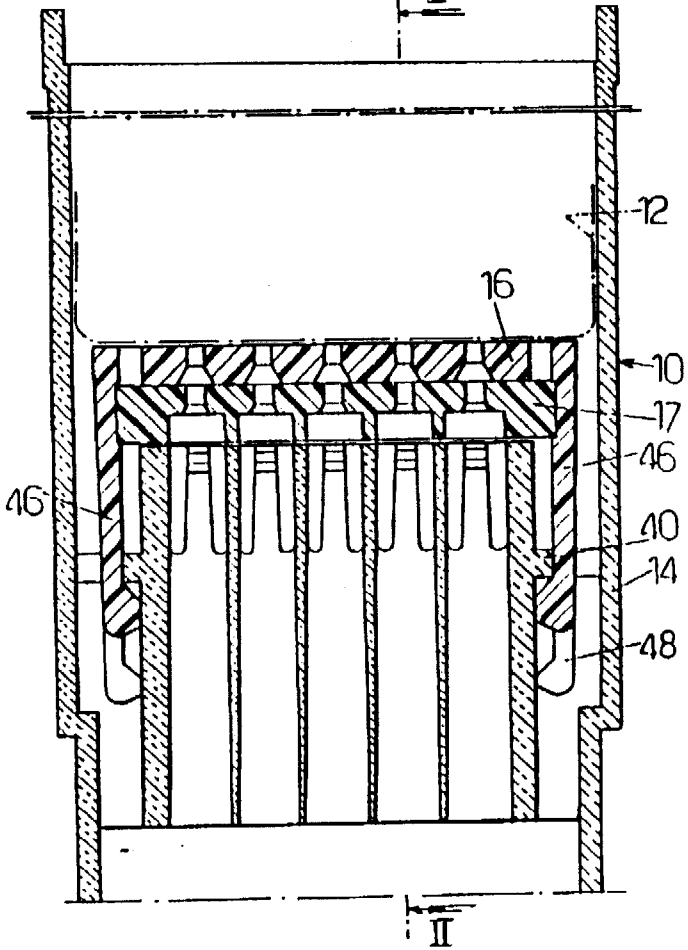
FIG. 1 is a section view of the complete connector along line I—I of FIG. 2 i.e., in section on the midplane of a row of passages.

The connector 10 shown in FIGS. 1 and 2 is designed to be coupled by plugging into a complementary connector whose outline is shown schematically in chain-dotted lines. By way of example, the complementary connector 12 may be of the type described in U.S. patent application No. 08/594,965 filed on the same day as the present application and entitled "A connector having a grid for secondary locking of terminals". It is assumed below that the connector 12 is designed to receive cage-shaped female contact terminals, whereas the connector 10 is designed to receive contacts 13 in the form of tongues (FIG. 2A). Mowever this disposition is not exclusive in any way.

The connector 10 may be considered as comprising a body 14 of insulating material (generally a filled plastic material) manufactured by molding, a locking grid 16, and a retaining plate 17. The one-piece body has a central core and a casing projecting forwards and backwards. The forwardly projecting portion receives the matching connector. In some applications, the connector may have a grommet and a plate for compressing the grommet. The connector may also include sealing means that are not described since they may be of conventional structure and they are not directly concerned by the invention.

The core of the body 14 of the connector 10 shown is formed with only two rows of passages 24 extending parallel to the plugging direction. The number of rows may be different. The passages are of rectangular section I.e., that is substantially constant along their entire length. They open out through the front face of the core of the body.

Detents 32 are cut out in each of the walls of the core of the body that are parallel to the rows, with each detent 32 having an inwardly directed catch 34 projecting into the passage when the detent is relaxed. The back of the catch has a slope enabling the terminal 13 to be inserted. The front of the catch has an abrupt face for preventing the terminal 13 being withdrawn once the catch has engaged in a locking window 36 in the terminal.

Each of the two faces of the core of the body that are parallel to the rows has an external fastening strip 38 directed towards the casing for the purpose of retaining the holding plate 17, as explained below. The faces orthogonal to the rows likewise have respective external transverse projecting strips 40 for the purpose of latching the grid 16. The ends of these strips connect the core to the casing.

The retaining plate 17 (FIGS. 7–9) serves in particular to retain the terminals until the grid 16 is in place. It comprises a single piece of molded insulating material. It can be regarded as having an end wall for bearing against the front face of the core of the body 14 and four resilient fingers 42 each provided with an inwardly directly terminal lug. The lugs are designed to latch on respective strips 38. Stepped holes are formed through the end wall. The steps in the holes are designed to bear against the transition zone between the cage and the tongue of the corresponding terminal. The plate thus limits forward displacement of the terminals 13 once the fingers are latched.

The retaining place as shown has a longitudinal rib 44 at the entrance to each hole. The rib is designed to engage in a notch in the respective terminal and to ensure that the terminal is inserted only in an orientation in which it can be locked.

The grid 16 (FIGS. 1 to 6) has an end wall which, when the connector 10 is assembled, bears against the retaining plate and forces it against the core of the body 14. This end wall is formed with holes situated in register with the holes through The end wall of the plate. To hold the grid 16 in place, the grid includes resilient tabs 46 for fastening on the strips 40, there being four such tabs in the embodiment shown. The grid has two flanks 50 parallel to the rows of passages and designed to be inserted between the core of the body and the fingers 42 and to prevent the detents 32 from bending outwards.

In the embodiment shown, the core of the body has two opposite detents for each terminal. For this purpose, a separating partition 52 is placed between two adjacent rows of terminals. The partition is cut out to constitute additional detents 32*a*. A middle groove 54 is also cut out in the partition 52. The grid 16 includes a projection 56 parallel to the flanks and designed to pass through a slot 58 in the plate 17 and to engage in the groove 54 to prevent the detents 32*a* from bending and releasing the corresponding terminals.

The grid 16 further has two temporary retaining tabs 48 situated halfway between pairs of the tabs 46, and longer than the tabs 46. Thus, when the grid is partially pushed in so that only the terminal lugs of the additional tabs have gone past the strip 40, the grid 16 allows the detents to spread apart under pressure from the terminals while the terminals are being inserted.

The connector may be assembled as follows.

The retaining plate is inserted into the body until its fingers 42 have latched onto the strips 38. Then the grid 16 is pushed in from the top (as shown in FIG. 1) but only far enough for the lugs of the additional tabs 48 to move past the strip 40. The terminals are then located and pushed in, until the catches of the detents 32 and 32*a* have engaged in the windows of the terminals (FIG. 2*a*). In its forward position, the grid centers the contacts. The resilience of the detents is sufficient to hold the terminals temporarily in place. Once all of the terminals have been pushed home fully, the grid 16 is moved to the position in which it as shown in FIG. 1, so as to lock the detents. If one of the terminals is not pushed home fully, then the corresponding detents project and prevent the grid from being moved into its final locking position.

Examination of the drawings will show that all of the components can easily be made by molding. Since the retaining plate 17 is separate from the body, the body can be unmolded easily even though the casing is connected to the central core at four locations.

The invention is not limited to the particular embodiment described above by way of example. Numerous modifications are possible. The number of rows may be greater than two. The terminals may be of a shape that is different from that show, with the shapes of the holes in the retaining plate 17 and in the grid 18 being modified accordingly.

I claim:

1. An electrical connector for coupling to a complementary connector by plugging said connector comprising:

(a) a body of rectangular cross-section made of insulating material and formed with at least two rows of passages parallel to a plugging direction and receiving respective contact terminals, each of said passages having at least one side wall which is parallel to the rows and is cut out to form detents whose resilience tends to bring them into a position where they project into the respective passage and where they retain the respective contact terminals;

(b) a front retaining plate arranged for bearing against a front end face of the body, formed with holes each allowing a projecting end portion of one of said terminals to pass through and constituting an abutment for a shoulder on the respective terminal, said retaining plate being provided with resilient retaining fingers arranged for engaging said body; and (c) a locking grid made as a single part and having: two side flanks that are spaced apart so as to straddle two faces of the body that are parallel to the rows and to prevent said detents from flexing away from the positions in which they project into the passages; and tabs for latching on two faces of the body that are orthogonal to the rows, for holding an end wall of the grid against the front retaining place, said end wall being formed with holes for said projecting end portions.

2. The connector according to claim 1, wherein said grid further comprises a pair of additional tabs for temporary retention of said grid on said body, longer than the first named tabs and arranged to retain said grid in a forward position where it enables said detents to move apart and to release said contact terminals.

3. The connector according to claim 1, wherein said body further includes a separating partition between adjacent rows of passages, and pairs of detents are cut out in said partition whereby each said terminal is retained by two detents.

4. The connector according to claim 3, wherein said partition has a middle groove between pairs of said detents and said grid has a projection for engaging into said groove and preventing the detents of a same pair formed in the partition from moving towards each other.

5. The connector according to claim 1, wherein said terminals each have a cage-shaped rear section with a pair of detent-receiving windows and a strip-shaped front section which projects through aligned one of said holes in the front plate and a respective one of said holes in the locking grid.

6. The connector according to claim 5, wherein said grid has passages formed for guiding said terminals during insertion of the latter.

7. The connector according to claim 2, wherein said body further includes a separating partition located between adjacent rows of passages and formed with pairs of detents, whereby each said terminal is retained by two detents.

8. An electrical connector having:

(a) a body of rectangular cross-section made of insulating material and formed with at least two rows of passages parallel to a plugging direction and receiving respective contact terminals, each of said passages having an outer side wall which is parallel to the rows and is formed with detents whose resilience tends to bring said detents into a position where they project into respective said passages and where they retain the respective contact terminals;

(b) a front retaining plate formed with holes each allowing a projecting end portion of one of said contact terminals to pass through and constituting an abutment for a shoulder on the respective contact terminal, said retaining plate being provided with resilient fingers arranged for engaging said body and retaining said front retaining plate against said body; and (c) a locking grid made as a single part and having an end wall formed with holes for said projecting end portions; two side flanks that are spaced apart so that each of said side flanks is in sliding contact with one said outer side wall and said side flanks prevent said detents from flexing away from the positions in which they project into the passages; a first set of tabs for latching said locking grid on two faces of the body that are orthogonal to the rows in a position where said end wall of the locking grid is in contact with the front retaining plate; and a second set of tabs for temporary retention of said grid on said body, longer than the tabs of the first set and arranged to retain said grid in a forward position where said grid enables said detents to deflect and to release said contact terminals.

* * * * *